US008584304B2

(12) United States Patent
DeHart

(10) Patent No.: US 8,584,304 B2
(45) Date of Patent: Nov. 19, 2013

(54) PAINT PAD AND PAINT PAD TRAY ASSEMBLY

(76) Inventor: Damon H. DeHart, Bedford, MA (US)

( * ) Notice: Subject to any disclaimer, the term of this patent is extended or adjusted under 35 U.S.C. 154(b) by 515 days.

(21) Appl. No.: 12/798,547

(22) Filed: Apr. 6, 2010

(65) Prior Publication Data

US 2010/0252459 A1 Oct. 7, 2010

Related U.S. Application Data

(60) Provisional application No. 61/212,002, filed on Apr. 6, 2009.

(51) Int. Cl.
*A47L 13/56* (2006.01)
*A47L 1/06* (2006.01)

(52) U.S. Cl.
USPC ..... 15/257.05; 15/210.1

(58) Field of Classification Search
USPC ..... 15/209.1, 210.1, 257.05, 257.06, 15/104.92; 401/218
See application file for complete search history.

(56) References Cited

U.S. PATENT DOCUMENTS 2,654,109 A * 10/1953 Barnes ..... 15/104.92
2,810,148 A 10/1957 Wood, Jr.
3,648,322 A * 3/1972 Meisner ..... 15/257.05
4,023,702 A 5/1977 McKnight
4,107,815 A * 8/1978 Dumesnil, Jr. ..... 15/257.05
4,164,803 A 8/1979 Zurawin
4,205,411 A 6/1980 Cupp
D297,676 S 9/1988 Ross
4,815,604 A 3/1989 O'Neil et al.
5,277,509 A * 1/1994 Danehy ..... 401/208
5,400,916 A 3/1995 Weber
5,553,701 A 9/1996 Jarecki
6,019,241 A 2/2000 Burns
7,410,074 B1 8/2008 Brunning

* cited by examiner

*Primary Examiner* — Rachel Steitz
(74) *Attorney, Agent, or Firm* — Francis H. Kirkpatrick

(57) ABSTRACT

A painting kit includes one or more paint pads and a paint tray. The paint tray includes a reservoir for holding a supply of paint, and means for transferring paint to a paint pad. In one embodiment the paint tray includes a rotating cylinder to transfer paint from the paint reservoir to one or more paint pads. In another embodiment, one or more paint pedestal surfaces are coated with paint from the reservoir in order to transfer paint to paint pads. Each of the paint pads and the trays includes features to selectively apply paint to the paint pad and to avoid applying paint to selected longitudinal edges of the paint pad. The lack of paint along the longitudinal edges helps to prevent paint from dripping or being forced from the longitudinal edge onto adjacent dry surfaces, and thereby enables a user to paint uniformly near edges while avoiding adjacent areas.

1 Claim, 5 Drawing Sheets

PAINT PAD AND PAINT PAD TRAY ASSEMBLY

This application claims the benefit of the priority of provisional application 61/212,002, filed Apr. 6, 2009, which is hereby incorporated by reference in its entirety.

FIELD OF THE INVENTION

The present invention relates generally to apparatus and method for applying paint to one or more paint pads that have a particular size and or configuration. In particular, a paint tray, including a paint reservoir and one or more paint applicators which can be placed in fluid communication with the paint reservoir, is configured to apply paint onto one or more paint pads suitably matched in size and shape to the paint applicators. The apparatus and method are particularly useful when working near boundaries of areas to be painted.

DESCRIPTION OF THE RELATED ART

Paint pads are used to "cut in" edges of a surface to be painted. In particular, paint pads may be used to paint edges of the surface to be painted that border other surfaces that are not being painted. For example, surfaces to be painted may comprise walls that border a ceiling that is not being painted. A paint pad is used to paint or cut in the walls along border edges up to the ceiling without painting the ceiling. In other examples, a wall may include windows, doors, trim and other elements that are not to be painted. The paint pad is used to paint or cut in the walls along border edges up to the windows, doors, trim and other elements.

In these examples, the shape and dimensions of the paint pad may be somewhat arbitrary. An example of a paint pad suitable for cutting in wall edges is disclosed in U.S. Pat. No. 2,810,148 which shows a paint absorbing pad made from mohair fabric supported on a substantially rigid backing. A user handle, for easy handling while painting, is attached to a base plate. In this example of the paint pad, the base plate, rigid backing and paint absorbing pad are rectangular in shape and the paint absorbing pad is removable from the base plate for replacement with a new paint absorbing pad or for cleaning the paint absorbing pad as may be required. In addition, the example paint pad includes a paint edge follower comprising a pair of wheels rotatably attached to the base plate along a guided or leading edge of the paint pad. In use, the wheels make rolling contact with a guide surface such as a ceiling, wall, door frame, window frame, trim or other feature that is not being painted in order to guide the leading edge of the paint pad as the paint pad is moved linearly with the guide surfaces in order to apply paint onto the surface being painted right up to the border edge between the surface being painted and the guide surface, but without applying any paint onto the guide surface. In the '148 patent example, the paint pad is approximately planar and rectangular in shape and the guided or leading edge of the paint pad is substantially collinear with a line formed by the edge follower which in this example is the rolling contact points made by the wheels with the guide surface.

In a further example, paint pads are available in different sizes and shapes to paint a particular feature such as a window mullion, a molding, trim piece or the like. Moreover, such paint pads do not necessarily include a paint edge follower but instead rely on the skill of the user to guide the paint pad along the surface being painted without applying paint to bordering surfaces that are not being painted. In particular, a paint pad having a width dimension sized to match the width of the window mullion, molding or trim piece may be used to paint these elements without painting bordering elements such as a window pane, ceiling, floor, or other border feature that is not being painted. When the width of the paint pad approximates the width of the feature being painted, two opposing edges of the paint pad may be bordering a surface that is not being painted, and it is important that the two edges of the paint pad paint right up to edges of the surface being painted without applying any paint onto a bordering surface that is not being painted.

Typically, paint is applied onto a paint pad by dipping the paint pad into a paint reservoir, such as a conventional paint tray used to apply paint to a paint roller, a paint can, a pail or other container. However, paint-absorbing pads usually absorb too much paint from the paint reservoir, and this leads to paint drops dripping from the paint pad. One problem is that paint may drip from the paint pad as the user transfers the paint pad from the reservoir to the surface being painted. Another problem is paint getting onto the guide wheels or edge follower and then inadvertently transferring the paint to the surfaces that are not to be painted. Another problem is that excess paint may be forced out of the paint pad during initial painting strokes and the excess paint can drip down the surface being painted or fall onto surfaces that are not being painted. Another problem is that a user may apply too much paint pressure on the paint pad, especially during initial painting strokes, such that excess paint can be forced out of the leading edge of the paint pad and onto the guide surface that is not being painted.

Another problem that occurs when the width of the paint pad approximates the width of the feature being painted is that excess paint on the paint pad can be forced out of the paint pad along edges and onto surfaces that are not being painted. Since paint that falls on surfaces that are not being painted must be cleaned away before the paint dries and since excess paint that falls onto a surface that is being painted must be uniformly spread onto the surface before the paint dries, any paint that drips or is otherwise expelled from a paint pad tends to slow the painting process and leads to undesirable results. In addition, there is a problem when not enough paint is applied to a paint pad since a lack of paint on the paint pad can lead to paint holidays and non-uniform coverage along border edges which are also undesirable results.

To avoid the problem of excess paint on the paint pad, the user removes excess paint from the paint pad after it has been dipped in the paint reservoir. This is typically done by wiping the paint pad over an edge or flat surface of the paint container or by contacting the paint pad with a flat surface and applying a force on the paint pad along a direction that forces excess paint to flow out of the porous paint absorbing pad or by wiping excess paint with a rag. Alternately a combination of wiping the paint pad and forcing the paint pad against a flat surface can be used to remove excess paint. One problem with the prior art method of applying paint to a painting pad and removing excess paint from the paint pad is that paint is often not applied uniformly over the entire area of the pad and this may cause paint to drip out of the paint pad and or lead to non-uniform surface painting.

An alternative device and method for applying paint to a paint pad is disclosed in U.S. Pat. No. 4,164,803, which includes a cylindrically shaped paint transfer roller, rotatably supported in a conventional paint tray with the transfer roller partially submerged in a paint reservoir. To apply paint to a paint pad, the paint pad is moved across the top of the transfer roller thereby causing the transfer roller to rotate with respect to the paint reservoir. Rotation of the roller picks up paint from the reservoir and the paint picked up by the transfer roller is transferred to the entire surface of the paint pad by wicking or absorption. The transfer roller allows a user to apply paint to a paint pad without dipping the paint pad into the reservoir and therefore helps to reduce the amount of excess paint absorbed by the paint pad.

In another example of the prior art, a painting kit, including a paint tray, a paint pad and a cover that fits over an opening of the paint tray to close the paint tray, is disclosed in U.S. Pat. No. 5,553,701. The paint tray is sized to package the paint pad inside for display and storage purposes. The tray includes a trough formed by a front wall, side walls and a downwardly and inwardly inclined rear wall rising from the base of the front wall. The trough provides a paint reservoir. The downwardly and inwardly inclined rear wall provides the painting supply surface for the entire surface of the paint pad. The inclined rear wall is formed with larger dimensions so that the paint pad can be stored inside the tray with the cover on.

Conventional paint pads and devices for applying paint to paint pads can leave the paint pad non-uniformly coated with paint. As a result, paint "holidays" (skipped areas) may occur if not enough paint is applied to the paint pad, or paint can drip or otherwise be inadvertently expelled from the paint pad if too much paint is applied to the paint pad. As a result, paint coverage along cut in edges is non-uniform and the work of painting edges with a paint pad is slowed down to correct the non-uniform coverage and to clean paint from surfaces that are not being painted.

Paint trays with rollers for transferring the paint from a reservoir in the tray to a paint pad assembly are known in the art. The relative size of the roller to the paint pad size affects the performance and ease of using the painting kit. For example, a larger roller is generally desired over a smaller roller as it will allow more paint in the tray reservoir thereby decreasing the need to refill the reservoir frequently. There can be a problem when larger rollers are used with relatively smaller paint pad assemblies such as paint pad assembly (40). When a larger roller rotates during the transfer of paint process to the smaller paint pad, the larger roller only rotates a small percentage of its circumference, due to the relatively short longitudinal length of the smaller paint pad, thereby advancing only a small amount of paint out from the reservoir and onto the transferring surface of the larger roller. The small rotation of the larger roller will not advance the paint enough to be acquired by the smaller roller. The advanced paint on the larger roller will cause an imbalance to the equilibrium of the larger roller and cause the larger roller to counter rotate and allow the section of the roller still containing paint roll back into the reservoir, leaving a "bare" spot at the top of the roller. The smaller paint pad must be placed again on the larger roller for another attempt at the transfer of paint process, but will be unsuccessful due to the paint roller turning back into the reservoir after each attempt. The generally practiced solution to this problem is to very quickly perform the transfer of paint process, trying to over-spin the larger roller and very quickly repeating the transfer of paint process before the advanced paint can sink back into the reservoir. The problem causes great frustration as the practiced solution is a difficult skill to acquire and can cause splashing of paint.

SUMMARY OF THE INVENTION

The present invention overcomes the problems cited in the prior art by providing a painting kit that includes one or more paint pads, a paint tray that includes a paint reservoir, and one or more transfer surfaces associated with the paint tray for transferring paint from a paint reservoir to the paint pad. In addition, each paint transfer surface is sized to transfer paint only onto selected portions of the paint pad in order to leave some regions of the paint pad, and especially edges of the paint pad, without paint, so as to allow those areas to absorb or wick excess paint to prevent the excess paint from being expelled from edges of the paint pad.

It is an object of the present invention to provide a painting kit that includes a paint pad configured with an edge follower suitable for cutting in edges of a flat surface being painted, a reservoir for holding a paint supply, and a transfer surface associated with the paint tray for transferring paint from the reservoir to a selected portion of the paint pad.

It is a further object of the present invention to provide a paint application system that includes a paint pad sized and/or shaped to paint a non flat surface such as a window mullion, molding or other trim element being painted, a reservoir for holding a paint supply and a transfer surface associated with the paint tray for transferring paint from the reservoir to a selected portion of the paint pad.

It is a further object of the present invention to provide a method for painting with a paint pad that includes the step of applying paint to less than the entire area of the paint pad. Other objectives and advantages of the invention will become apparent from the following description of the invention.

BRIEF DESCRIPTION OF THE DRAWINGS

The features of the present invention will best be understood from a detailed description of the invention and preferred embodiments thereof selected for the purposes of illustration and shown in the accompanying drawings in which.

DESCRIPTION OF THE PREFERRED EMBODIMENTS

Figure 1:
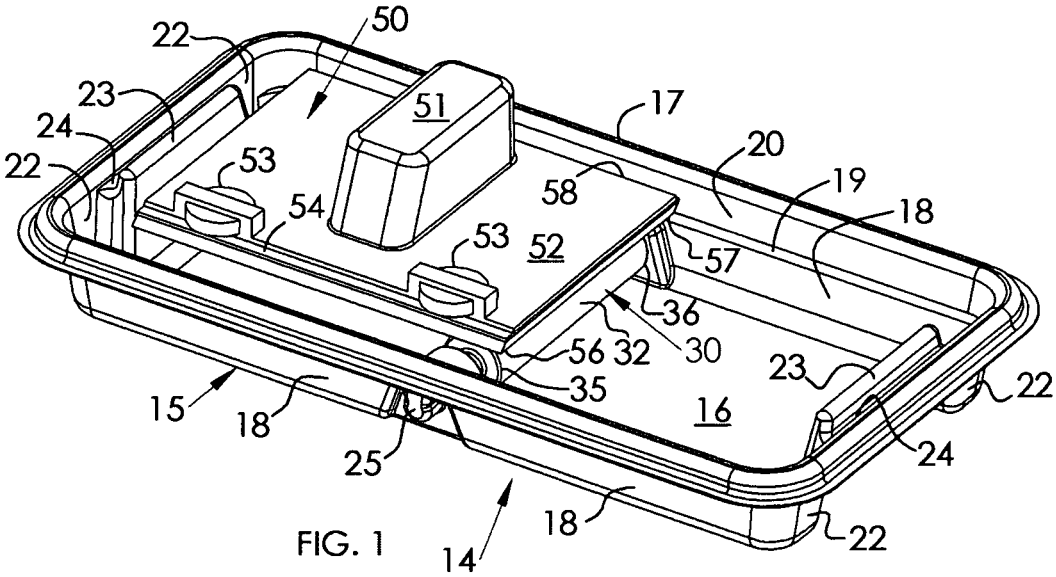
FIG. 1 is a perspective view of a first painting kit shown with a first paint pad in contact with a paint transfer roller according to the present invention.
Figure 2:
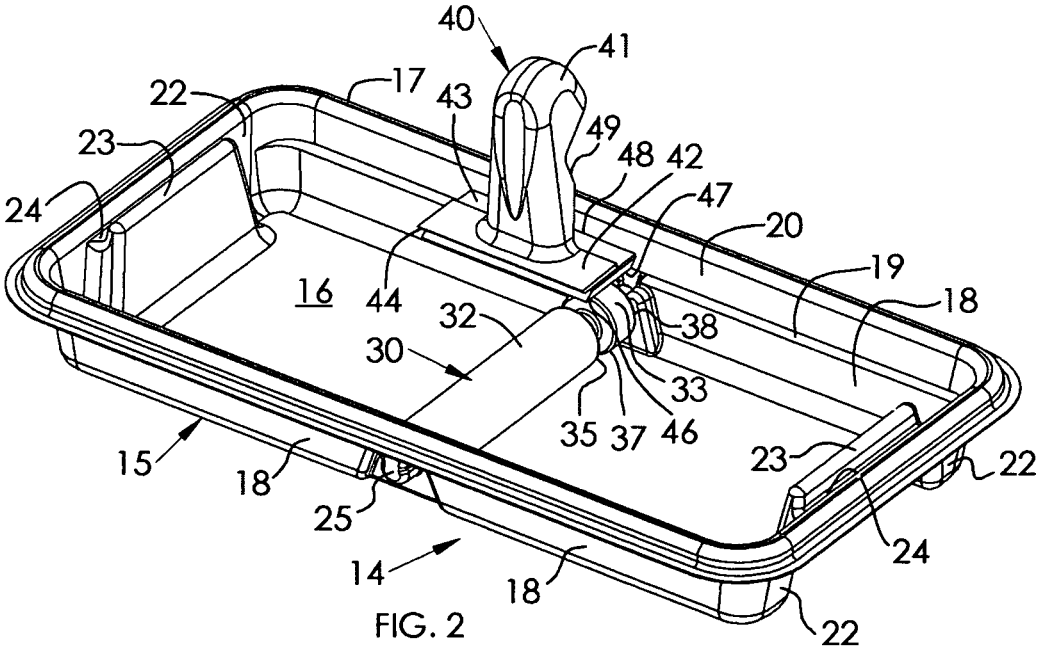
FIG. 2 is a perspective view of the first painting kit shown with a second paint pad in contact with a paint transfer roller according to the present invention.

This invention is directed to improved methods and devices for application of fluid coatings to surfaces. The exemplary embodiment is the painting of a wall or other conventionally painted surface. However, the applicator devices of the invention are capable of a wider range of use. Such a range covers at least other forms of decorative or protective coatings, such as, but not limited to, varnish, lacquer, whitewash, stain, moisture barriers, sealants, primers, antifriction agents, texturizing agents, controlled release preparations, and other sorts of coverings suitable for application by a paint roller or a functional equivalent thereof. Other surface-coating fluids are included in the term "paint" as used herein wherever such incorporation is functional.

Referring to FIGS. 1-6, with like reference numbers used to describe like elements, a first painting kit (14) according to the present invention includes a paint tray (15) made from a suitable material such as high density polyethylene plastic formed in a process such as vacuum forming or injection molding. The paint tray is formed with a longitudinal length and a shorter transverse width. The paint tray (15) includes a rolling paint applicator (paint transfer roller). The rolling paint applicator comprises a cylindrical roller (30) having a rotation axis disposed along the transverse width of the tray (15) with the cylindrical roller (30) supported for rotation with respect to opposing sidewalls (18) of the tray (15). The cylindrical roller (30) is partially submerged in a paint reservoir formed by the tray (15). The outside diameter of the cylindrical roller (30) provides a paint transfer surface for making contact with a paint pad in order to transfer paint from the reservoir to the paint pad in response to rotation of the cylindrical roller (30). The cylindrical roller (30) is made from a suitable plastic material such as polypropylene and is formed by a process such as blow molding or gas assist injection molding. Other cylindrical roller embodiments are usable without deviating from the present invention.

Referring to FIGS. 1-6, the first painting kit (14) includes a first paint pad assembly (50) suitable for application of paint in the process of cutting in edges of a surface to be painted. The first painting kit (14) may also include a second paint pad assembly (40) suitable for painting window mullions, moldings or other trim items. Each paint pad assembly (40) or (50) includes a paint absorbing pad (45) or (55) (FIG. 6, FIG. 4) suitable for absorbing or wicking paint therein and releasing the paint onto a surface being painted when the paint pad (45) or (55) is placed in contact with and moved along an edge of the surface being painted. The paint absorbing pads (45) and (55) comprise brush bristles, open cell foam, woven fabric or various other fluid absorbing or wicking materials suitable for painting. Each paint pad assembly (40) and (50) further includes a handle (41, 51) formed to allow a user to manipulate the paint pad assembly. The handle (41, 51) is attached to a base plate (42, 52) of generally planar rectangular shape. The base plates and handles are preferably formed from a suitable plastic material such as polyethylene and formed in a process such as injection molding.

In a preferred embodiment, a rigid backing (43, 54) is disposed between the paint pad (45, 55) and the base plate (42, 52) with the rigid backing removably attached to the base plate and with the paint pad (45, 55) fixedly attached to the rigid backing (43, 54), e.g. by adhesive, heat welding, chemical bonding or other suitable attaching means. The rigid backing (43, 54) is preferably made from a suitable sheet plastic material such as polyethylene and formed in a suitable process such as die cutting and heat forming. Alternately, the rigid backing can be formed in a process such as injection molding.

The rigid backing (43, 54) is generally shaped and sized to match the size and shape of the paint pad and serves to keep the paint pad flat on the paint surface. Preferably, the rigid backing (43, 54) and attached paint pad (45, 55) are removable from base plate (42, 52) for cleaning or replacement. Accordingly both the rigid backing (43, 54) and the base plate (42, 52) may include features suitable for attaching the rigid back to the base plate such as friction and or compression clamps, fasteners or other suitable attaching means. In other embodiments, the paint pad assemblies (40) and or (50) may be disposable after a single use and configured with the paint pad (45, 55) permanently attached directly to the base plate (42, 52).

The first paint pad (55) includes opposing and substantially parallel longitudinal edges (56) and (57) and opposing substantially parallel transverse edges. The first paint pad assembly (50) includes an edge follower, e.g. the wheels (53), disposed along a leading or guided longitudinal edge (56) of the paint pad (55) for guiding the first paint pad assembly (50) along a guide surface during painting. Other edge followers are usable with out deviating from the present invention.

The second paint pad (45) includes opposing and substantially parallel longitudinal edges (46) and (47) and opposing substantially parallel transverse edges. The second paint pad assembly (40) includes an edge follower (44) disposed along a leading or guided edge (46) of the paint pad (45) for guiding the second paint pad assembly (40) along a guide surface being painted. Other edge followers are usable with out deviating from the present invention.

The tray (15) comprises a bottom floor (16) which along with a pair of opposing end walls (22) originating from the bottom floor (16) and extending substantially vertically upward therefrom to a periphery top flange (17) and a pair of opposing side walls (18) originating from the bottom floor (16) and extending substantially vertically upward to horizontal ledges (19) form a reservoir for holding paint or another fluid. Each side wall (18) is formed to provide a longitudinal guide surface (20). Each guide surface (20) is used to locate and guide a longitudinal guide edge (48) and (58) of a corresponding paint pad (40) or (50) as paint is transferred to the paint pad by the cylindrical paint roller (30). In addition, each side wall (18) is further formed to provide a substantially horizontal ledge (19). The horizontal ledge (19) is used to horizontally orient a corresponding paint pad (40) or (50) as paint is transferred to the paint pad by the cylindrical paint roller (30).

The tray (15) may include wipers (23) formed integral with opposing ends walls (22) for wiping excess paint from the paint pads if needed. In FIGS. 1-6, the wipers (23) originate from the bottom floor (16) and rise above top flange (17), then descend to valley drains (24) and terminate into end walls (22).

The side walls (18) are formed with roller support features (25), e.g. a blind slot, positioned approximately midway along the longitudinal length of the tray (15). The cylindrical transfer roller (30) includes journals (31), e.g. fixed cylindrical shaft portions, extending out from each end of the cylindrical paint transfer roller (30), coaxial with a central axis of the cylinder outside diameter(s), and the journals (31) define a rotation axis of the roller (30). The journals (31) engage with the roller support features (25), e.g. by dropping into the slot, such that the paint roller (30) is rotationally supported with respect to the side walls (18).

The paint transfer roller (30) further includes two paint transfer surfaces comprising a first cylindrical diameter (32) and a second cylindrical diameter (33), which in the preferred embodiment are coaxial and have the same diameter. The first cylindrical diameter (32) has a first axial length that extends from a first edge (35) to a second edge (36). In particular, the first axial length is less than the transverse width of the paint absorbing pad (55) of the first paint pad assembly (50) such that less than the entire width of the paint absorbing pad (55) of the first paint pad assembly (50) is coated with paint by the first cylindrical diameter (32). The second cylindrical diameter (33) has a second axial length that extends from a first edge (37) to a second edge (38). In particular, the second axial length is less than the transverse width of the paint absorbing pad (45) of the second paint pad assembly (40) such that less than the entire width of the paint absorbing pad (45) is coated with paint by the second cylindrical diameter (33).

Figure 3:
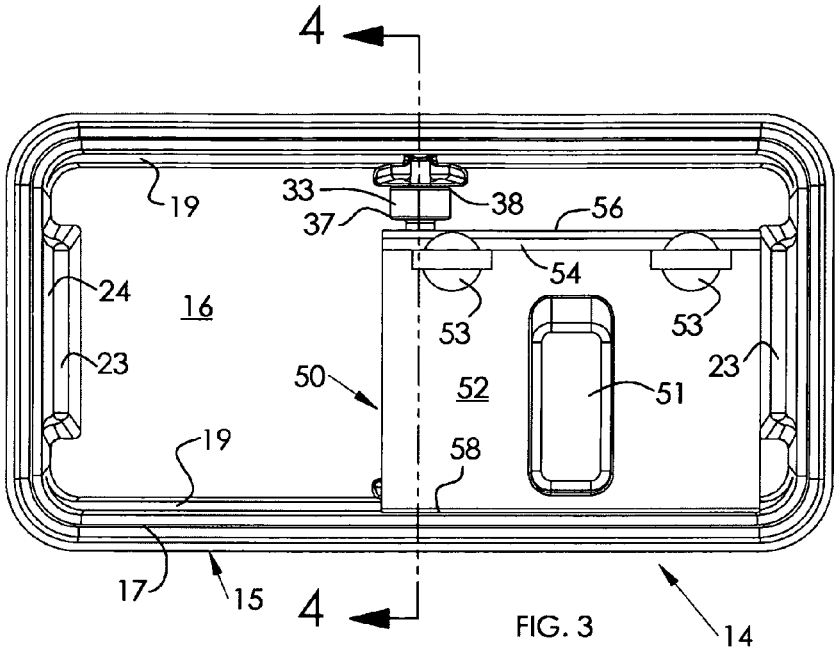
FIG. 3 is a top plan view of the first painting kit shown with a first paint pad in contact with a paint transfer roller according to the present invention.
Figure 4:
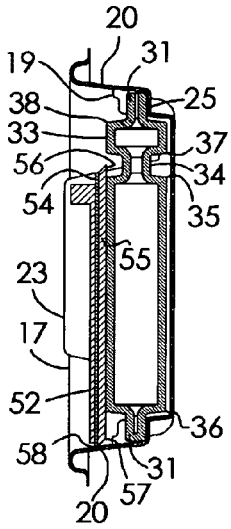
FIG. 4 is a sectional view 4-4 taken through the paint transfer roller with the first paint pad in contact therewith according to the present invention.

Referring now to FIGS. 3 and 4, after paint is poured into tray (15) to approximately the level of the journals (31), the first paint pad assembly (50) is positioned into tray (15). The first paint pad assembly (50) is positioned in a paint transfer position which places its paint absorbing pad (55) in contact with the first cylindrical diameter (32) and the longitudinal guide edge (58) in contact with the side guide (20) that is proximate to the first cylindrical diameter (32) and the underside of the longitudinal edge (57) resting on the horizontal ledge (19) that is proximate to the first cylindrical diameter (32). The paint pad assembly (50) is then moved longitudinally with respect to the paint tray while keeping the longitudinal guide edge (58) in contact with the side guide (20) and the underside of the paint pad longitudinal edge (57) in contact with the horizontal ledge (19).

As the paint pad assembly (50) is moved in reciprocating motion over the cylindrical roller (30), the roller (30) picks up paint from the reservoir and transfers paint to the paint absorbing pad (55). The horizontal ledge (19) prevents the paint absorbing pad (55) from tilting into the paint reservoir and absorbing too much paint. The side guide (20) locates the longitudinal guide edge (58) with respect to each of the cylindrical roller diameter edges (35) and (36) and the transverse width of the paint absorbing pad (55) is made larger than the axial length of the first cylindrical diameter (32) to ensure that neither of the longitudinal edges (56) and (57) of the paint absorbing pad (55) makes contact with the roller diameter (32) such that paint in not transferred to the paint absorbing pad (55) along either of the longitudinal edges (56) and (57). In a preferred embodiment the transverse width of the paint absorbing pad (55) is generally centered over the axial length of the cylindrical diameter (32) and the paint pad transverse width exceeds the axial length of the cylindrical diameter (32) by 0.125 to 0.5 inches. After the first paint pad (50) has been supplied with paint, a user may wipe excess paint from the paint pad by moving the pad over one of the wipers (23). Excess paint falling on the wipers (23) will flow from valley drains (24) and wipers (23) back into bottom (16).

To use the first paint pad assembly (50) to cut in and paint a straight border between abutting surfaces that form an inside angle such as at the junction of a wall and a ceiling, the paint pad assembly (50) is placed on a surface to be painted such as a wall. While keeping wheel followers (53) abutted against the ceiling or other border edge, the paint pad assembly (50) is moved in a linear reciprocating motion along the border edge. A compression or painting force applied through the handle to the paint absorbing pad (55) forces the paint pad against the wall being painted and forces paint to flow out of the paint pad and onto the wall. Since the longitudinal edges (56) and (57) were not supplied with paint, paint will flow from the region of the paint absorbing pad (55) that received paint to the longitudinal edges (56) and (57) and then onto the wall surface.

Thus according to one aspect of the present invention, when paint is not transferred to the paint absorbing pad (55) along its longitudinal edges (56) and (57), there is less paint proximate to the longitudinal edges to drip out of the paint pad when a paint pressure is applied to the paint pad. This provides an improved painting method which produces a crisp straight borderline at the junction between the wall being painted and a border such as a ceiling or edges of the wall not being painted. It should be noted that alternately, wheel followers (53) could abut against the tray side guide (20) to affect loading of paint, but if paint mistakenly gets on the side guide (20), wheel followers (53) will pick up paint and undesirably transfer paint to ceiling or other guide surfaces not to be painted.

Figure 6:
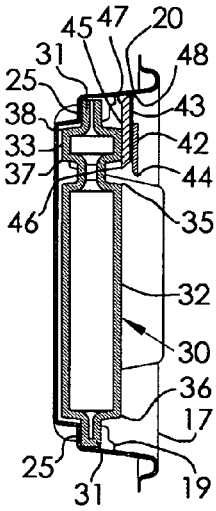
FIG. 6 is a sectional view 6-6 taken through the paint transfer roller with the second paint pad in contact therewith according to the present invention.
Figure 5:
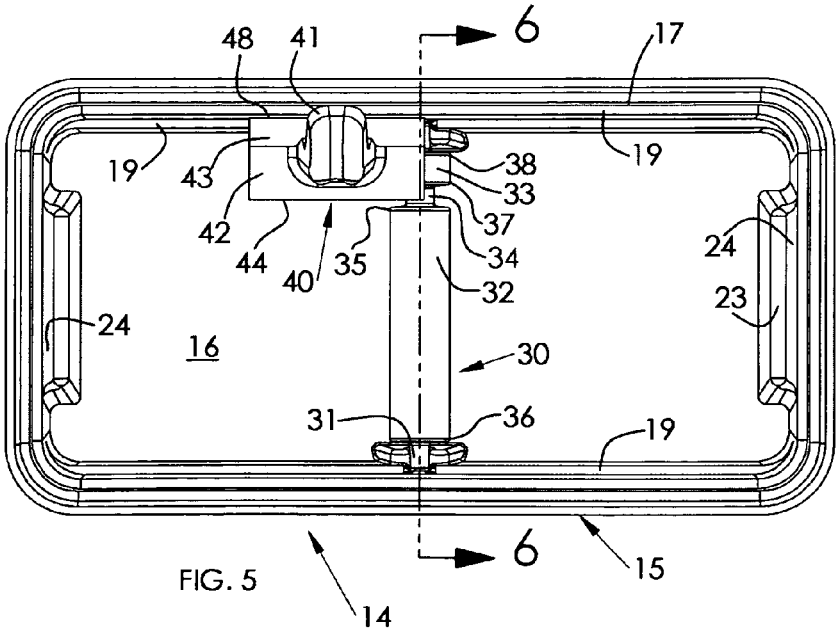
FIG. 5 is a top plan view of the first painting kit shown with a second paint pad in contact with a paint transfer roller according to the present invention.

Referring now to FIGS. 5 and 6, after paint is poured into tray (15) to approximately the level of the journals (31) of the paint transfer roller (30), the second paint pad assembly (40) is positioned into tray (15). The second paint pad assembly (40) is positioned in a paint transfer position which places its paint absorbing pad (45) in contact with the second cylindrical diameter (33), with the longitudinal guide edge (48) in contact with the side guide (20) that is proximate to the second cylindrical diameter (33) and with the underside of the paint absorbing pad (40) longitudinal edge (47) resting on the horizontal ledge (19) that is proximate to the second cylindrical diameter (33). The paint pad assembly (40) is then moved longitudinally with respect to the paint tray while keeping the longitudinal guide edge (48) in contact with the side guide (20) and the longitudinal edge (47) in contact with the horizontal ledge (19). As the paint pad assembly (40) is moved in a reciprocating motion over the cylindrical roller (30), the roller (30) picks up paint from the reservoir and transfers paint to the paint absorbing pad (45). The horizontal ledge (19) prevents the paint absorbing pad (45) from tilting into the paint reservoir and absorbing too much paint. The side guide (20) locates the longitudinal guide edge (48) with respect to each of the cylindrical roller diameter edges (37) and (38). The transverse width of the paint absorbing pad (45) is made larger than the axial length of the second cylindrical diameter (33) to ensure that neither of the longitudinal edges (46) and (47) of the paint absorbing pad (45) makes contact with the roller diameter (33) such that paint is not transferred to the paint absorbing pad (45) along either of the longitudinal edges (46) and (47). In a preferred embodiment the transverse width of the paint absorbing pad (45) is generally centered over the axial length of the second cylindrical diameter (33) and the transverse width of the paint absorbing pad (45) exceeds the axial length of the second cylindrical diameter (33) by 0.125 to 0.5 inches. After the second paint pad (40) has been supplied with paint, a user may wipe excess paint from the paint absorbing pad (45) by moving the paint pad assembly (40) over one of the wipers (23). Excess paint falling on the wipers (23) will flow from valley drains (24) and wipers (23) back into bottom (16).

To use the second paint pad assembly (40) to cut in and paint a window mullion, molding, trim element or other surface to be painted, the paint pad assembly (40) is placed on the surface to be painted with its protruding longitudinal edge follower (44) in contact with a guide surface such as a window pane or other surface that is not being painted. While keeping edge follower (44) abutted against the guide surface, the paint pad assembly (40) is moved in a linear reciprocating motion along the element being painted. A compression or painting force applied through the handle to the paint absorbing pad (45) forces the paint absorbing pad against the element being painted and forces paint to flow out of the paint absorbing pad and onto the element being painted. Since the paint absorbing pad (45) longitudinal edges (46) and (47) were not supplied with paint, paint will flow from the region of the paint absorbing pad (45) that received paint to the longitudinal edges (46) and (47) and then onto the element being painted. It should be noted that alternately, edge follower (44) could abut against the tray side guide (20) to effect loading of paint, but if paint mistakenly gets on the side guide (20), edge follower (44) will pick up paint and undesirably transfer paint to the surface that is not being painted.

Thus according to one aspect of the present invention when paint is not transferred to the paint absorbing pad (45) along its longitudinal edges (46) and (47) there is less paint proximate to the longitudinal edges to drip out of the paint pad (40) when a paint pressure is applied to the paint absorbing pad (45). This provides an improved painting method which produces a crisp straight borderline at the junction between the element being painted and a border such as a window pane or other guide surface that is not being painted.

In other embodiments of the present invention, the position of the side guides (20), the axial length of the roller diameters (32, 33) and/or the position of the roller edges (35, 36, 37, 38) may be configured differently to apply paint onto other selected regions of the paint pads (45, 55) e.g. to apply paint over the entire area of the pad except along one or the other longitudinal edge (46, 47, 56, 57).

Referring now to FIGS. 7-11 with like reference numbers used to describe like elements, a second painting kit (69) according to the present invention includes a paint tray (70) made from a suitable material such as high density polyethylene plastic and formed in a process such as vacuum forming or injection molding. The paint tray (70) is formed with a longitudinal length and a shorter transverse width. The paint tray (70) includes one or more pedestal surfaces (79) and (82) which when coated with paint are usable to transfer the paint coated thereon onto paint pads placed in contact with the pedestal surfaces. The second paint tray (69) includes a third paint pad assembly (60), which is similar to the first paint pad assembly (50) described above, and a second paint pad assembly (40) which is substantially identical to the second paint pad assembly (40) described above.

The tray (70) comprises a bottom surface which has a substantially horizontally disposed front portion (71), an inclined drain portion (74) and a rear portion that forms a leg (87) that supports the paint tray with respect to a floor or other support surface. The tray (70) further includes a front wall (72) that extends substantially vertically up from the bottom wall front portion (71) and terminates on the top at peripheral top lip (73) and opposing side walls (77) that extend substantially vertically up from side edges of the bottom wall front portion (71) that also terminate on the top at peripheral top lip (73). Both side walls (77) further includes a guide surface (78) that is used to locate the paint transfer position of the third paint pad assembly (60) when the third paint pad assembly is in contact with the first paint pedestal surface (79). The bottom wall front portion (71) along with the front wall (72), the front portions of the side walls (77), the stepped wall (80) and some of the inclined drain portion (74) together form a reservoir for holding paint or other fluids. The tray (70) further includes include a sloped top lip (76) formed at the top of guide surface (78), a skirt (90) which originates from sloped top lip (76), and peripheral top lip (73) extending substantially vertically downwardly and terminating at a generally horizontal flange (89). Further included is a leg wall (88), originating from leg (87), at the bottom and extending substantially vertically upward to terminate at sloped top lip (76).

The first paint pedestal surface (79) is suitable for transferring paint to the third paint pad assembly (60), and a second paint pedestal surface (82) is suitable for transferring paint to the second paint pad assembly (40). Each of the paint pedestal surfaces (79, 82) is disposed vertically above the level of fluid in the reservoir and vertically above the drain portion (74). The second pedestal surface (82) preferably originates at a back end of first pedestal surface (79) and is preferably disposed at an obtuse angle with respect thereto. The pedestal surfaces (79, 82) are connected to the drain portion (74), on both opposing sides, by substantially vertically disposed trough walls (81), at the front end by a substantially vertically disposed stepped wall (80) and at the rear end by a substantially vertically disposed back wall (86).

Figure 9:
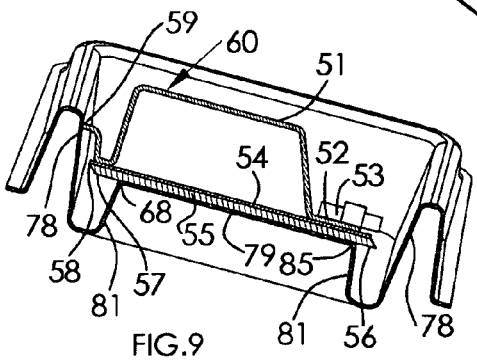
FIG. 9 is a sectional view 9-9 taken through the third paint pad in contact with the first pedestal transfer surface according to the present invention.
Figure 11:
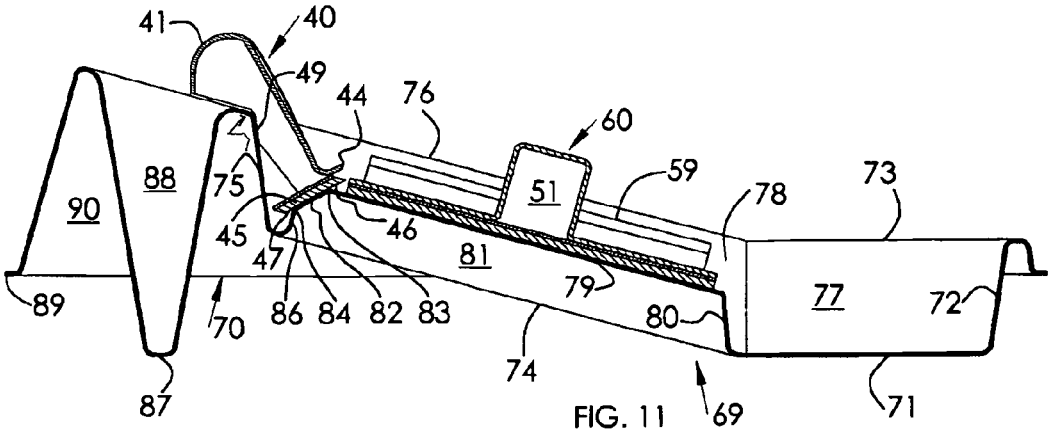
FIG. 11 is a sectional view 11-11 taken through a longitudinal axis of the second painting kit according to the present invention.

Each paint pedestal surface comprises a flat rectangular inclined surface formed with a longitudinal length and a transverse width. The first paint pedestal surface (79) has a longitudinal length that extends along the longitudinal length of the tray (70) and is equal to or greater than the longitudinal length of the paint absorbing pad (55) of the third paint pad assembly (60). As shown in FIG. 9, the first paint pedestal surface (79) has a transverse width extending from a front edge (85) to the rear edge (68) and the transverse width of the first paint pedestal surface (79) is less than the transverse width of the paint absorbing pad (55) of the third paint pad assembly (60). The second paint pedestal surface (82) has a longitudinal length that extends along the transverse axis of the tray (70) and is equal to or greater than the longitudinal length of the paint absorbing pad (45) of the second paint pad (40). As shown in FIG. 11, the second paint pedestal surface (82) has a transverse width that extends, along the longitudinal axis of the tray (70), from a front edge (83) to a back edge (84), and the transverse width of the second paint pedestal surface (82) is less than the transverse width of the paint absorbing pad (45) of the second paint pad (40).

It should be noted that although paint pedestal surfaces (79) and (82) are depicted as inclines to the horizontal, with slight modification to the design, pedestal surfaces (79) and (82) could be repositioned to be parallel to the horizontal and placed vertically higher than the reservoir holding paint or other fluids. Alternatively, paint pedestal surfaces such as (79) and (82) could be replenished with paint using an applicator, such as a paint brush or pad, or a roller, or other suitable device.

Figure 7:
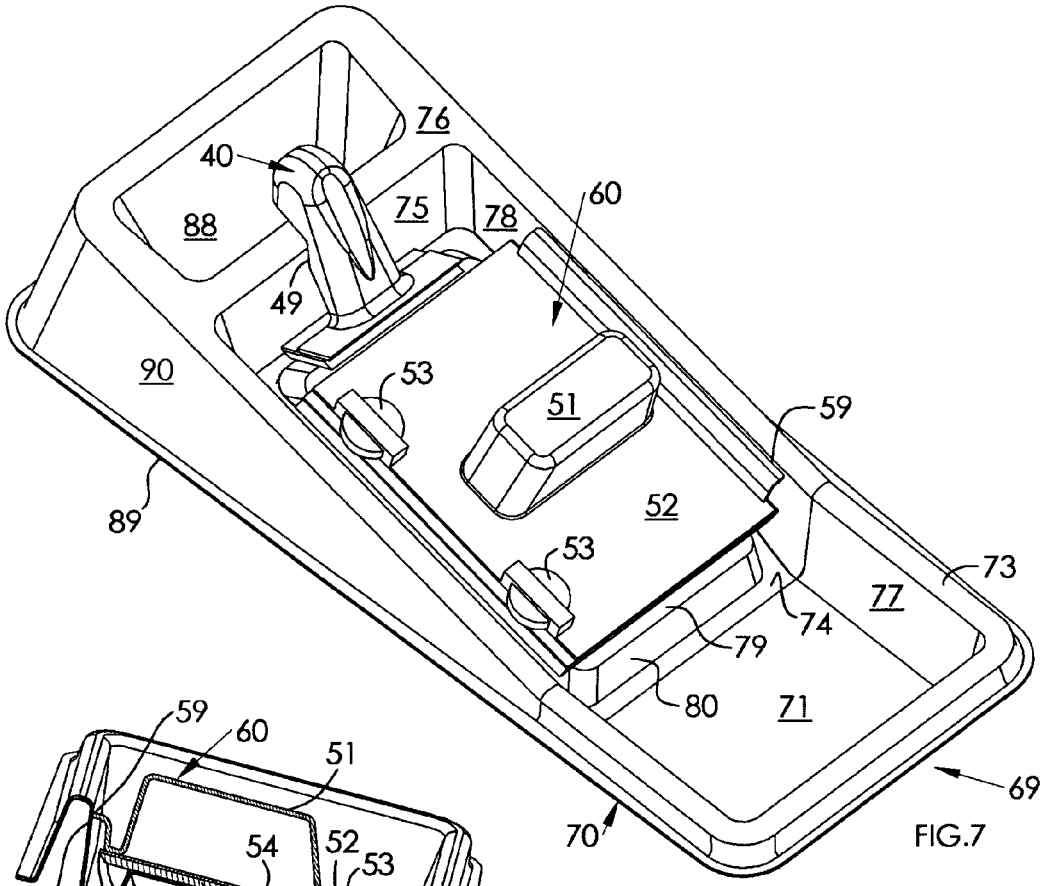
FIG. 7 is a perspective view of a second painting kit shown with a third paint pad in contact with a first pedestal paint transfer surface and a second paint pad in contact with a second pedestal paint transfer surface according to the present invention.
Figure 8:
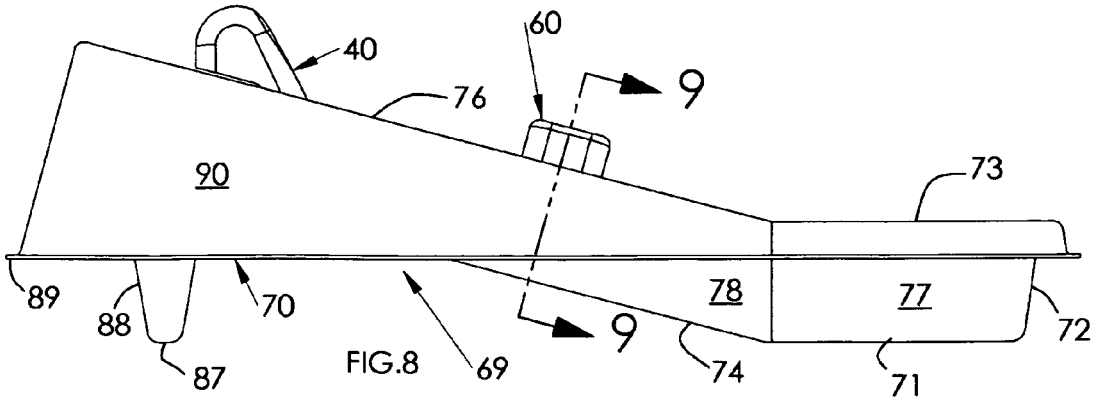
FIG. 8 is a side plan view of the second painting kit according to the present invention.
Figure 10:
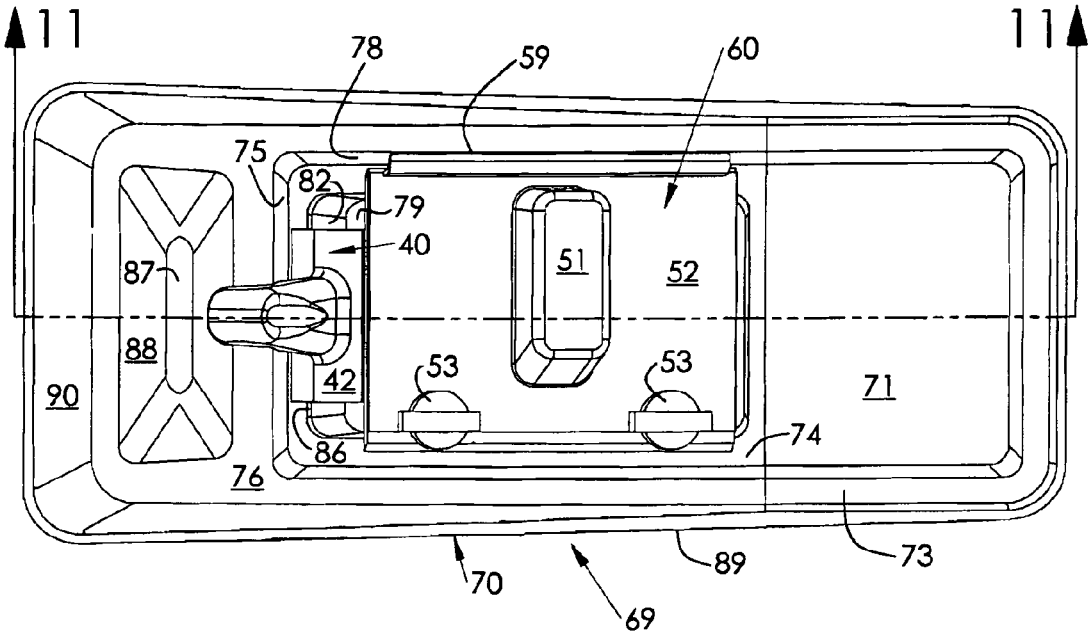
FIG. 10 is a top plan view of the second painting kit according to the present invention.

Referring now to FIGS. 7, 8 and 9, paint is poured into tray (70) to a level approximately to the top edge of stepped wall (80). In its normal resting position on a floor or flat horizontal surface, the front portion (71) of the bottom wall is substantially horizontal. To coat one or both paint pedestal surfaces the tray (70) is tilted by lifting the front edge by the peripheral top lip (73) until paint from the reservoir flows over the stepped wall (80) and up the inclined drain portion (74) until it covers the first paint pedestal surface (79) and if need the second paint pedestal surface (82). The tray is then lowered to its normal resting position and any excess paint drains back to the reservoir. The third paint pad assembly (60) is then positioned onto the first paint pedestal surface (79) to transfer the coating of paint applied thereto to the paint absorbing pad (55) of the third paint pad assembly (60). Alternately or additionally, the second paint pad (40) may be positioned onto the second paint pedestal surface (82) to transfer the coating of paint applied thereto to the paint absorbing pad (45) of the second paint pad assembly (40).

Referring to FIG. 9, the third paint pad assembly (60) includes a guide edge (59) which is disposed to contact the side wall guide surface (78) when the third paint pad assembly (60) is mounted onto the first paint pedestal surface (79). The guide edge (59) locates the paint absorbing pad (55) of the third paint pad assembly (60) along the transverse axis and specifically positions the paint absorbing pad (55) so that neither of its longitudinal edges (85) and (86) is in contact with the first paint pedestal surface (79) to thereby prevent the longitudinal edges (85) and (86) from having paint applied thereto by the first paint pedestal surface (79).

Referring now to FIGS. 4 and 9, it should be noted that the third paint pad assembly (60) could be used with tray (15) with minor changes to tray (15). The longitudinal ledge (19) could be repositioned vertically higher than its position as shown in tray (15). This would allow the guide edge (58) of paint pad assembly (60) to align with the longitudinal ledge (19) of paint tray (15). After paint is poured into tray (15) to approximately the level of the journals (31), the third paint pad assembly (60) is positioned into tray (15) in a paint transfer position. This places paint absorbing pad (55) in contact with the first cylindrical diameter (32) as shown in FIG. 4, with guide edge (58) in contact with the side guide (20) that is proximate to the first cylindrical diameter (32) and with the underside of the guide edge (58) resting on the horizontal ledge (19) that is proximate to the first cylindrical diameter (32).

The paint pad assembly (60) is then moved longitudinally with respect to the paint tray while keeping the guide edge (58) in contact with the side guide (20) and the underside of the guide edge (58) in contact with the horizontal ledge (19). As the paint pad (60) is moved in reciprocating motion over the cylindrical roller (30), the roller (30) picks up paint from the reservoir and transfers paint to the paint pad (55). The horizontal ledge (19) prevents the paint absorbing pad (55) from tilting into the paint reservoir and absorbing too much paint.

The side guide (20) locates the guide edge (58) with respect to each of the cylindrical roller diameter edges (35) and (36). The transverse width of the paint absorbing pad (55) is made larger than the axial length of the first cylindrical diameter (32) to ensure that neither of the longitudinal edges (56) and (57) of the paint absorbing pad (55) makes contact with the roller diameter (32) such that paint in not transferred to the paint absorbing pad (55) along either of the longitudinal edges (56) and (57).

In a preferred embodiment, the transverse width of the paint absorbing pad (55) is generally centered over the axial length of the cylindrical diameter (32) and the paint pad transverse width exceeds the axial length of the cylindrical diameter (32) by 0.125 to 0.5 inches. It should be noted that the transverse width of the paint absorbing pad (55) could be not centered, but instead be biased to one side to prevent the paint transfer to only one longitudinal edge (56) or (57). After the third paint pad (60) has been supplied with paint, a user may wipe excess paint from the paint pad by moving the pad over one of the wipers (23). Excess paint falling on the wipers (23) will flow from valley drains (24) and wipers (23) back into bottom (16).

Referring to FIG. 11, the second paint pad assembly (40) includes a aligner guide edge (49) disposed on the handle (41) and the aligner guide edge (49) is disposed to mate with a back guide wall (75) formed on the tray (70) when the second paint pad assembly (40) is mounted onto the second paint pedestal surface (82). The aligner guide edge (49) locates the paint absorbing pad (45) of the second paint pad assembly (40) and specifically positions the paint absorbing pad so that neither of its longitudinal edges (46) and (47) are in contact with the second paint pedestal surface (82) to thereby prevent the longitudinal edges (46) and (47) from having paint applied thereto by the paint pedestal surface (82).

Each of the paint pads (40) and (60) is used to cut in straight borders between abutting surfaces such as to paint window mullions, moldings and trim elements as described above.

The problem of backwards rotation of the transfer roller, resulting in uneven transfer of paint to an applicator, such as a paint pad assembly, have been described above. The present invention overcomes these problems with a novel anti-rotation means to prevent the larger roller from counter-rotating between the transfer of paint process, allowing the advanced paint on the paint transfer roller (110) to be acquired by the paint pad assembly.

Figure 12:
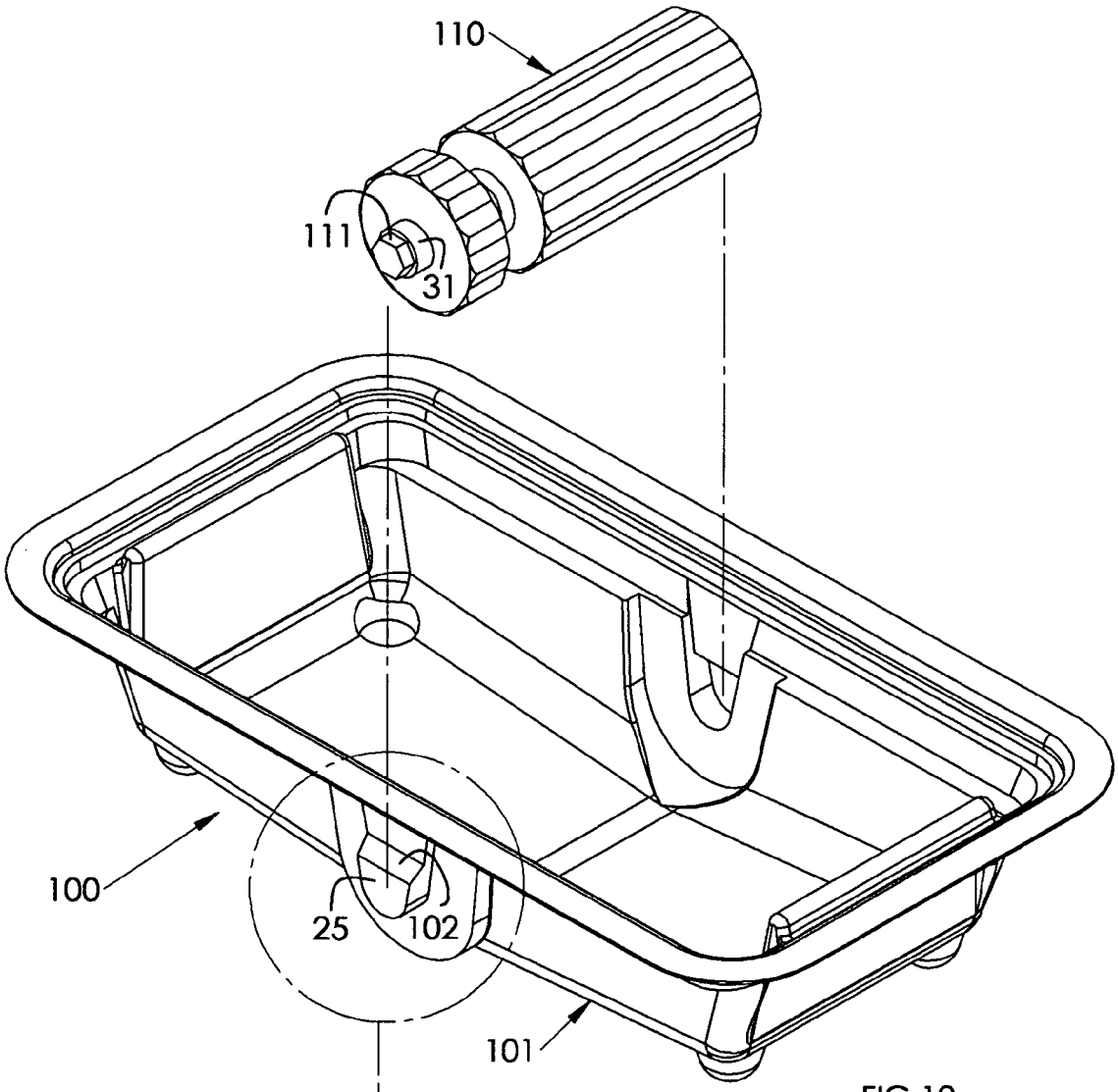
FIG. 12 is a perspective view of a third painting kit that is shown with the paint roller elevated above the paint tray, for clarity.
Figure 13:
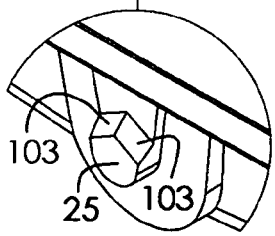
FIG. 13 is a detail of a roller support feature with an alternative anti-rotation means.

Referring now to FIGS. 12 and 13, the third painting kit (100) is similar to the first painting kit (14) with additional features. The paint transfer roller (110) is similar to the cylindrical roller (30) with additional features. The paint transfer roller (110) also includes, extending from and coaxial with the journals (31), polygon shaped protruding polygon ends (111). The polygon ends (111) consist of three or more surfaces, typically of equal or approximately equal length, joining at equal or approximately equal angles to each other. The corners of the angles preferably fall on a circle concentric with the journals (31).

The paint holding tray (101) also includes one or more horizontal anti-rotation means (102) or one or more angled anti-rotation means (103). The horizontal anti-rotation means (102) consists of a generally planar surface attached and spaced above the support feature (25), allowably positioned either horizontally or at an angle to the horizontal. The angled anti-rotation means (103) consists of one or more generally planar surfaces attached and spaced above the support feature (25). Preferred positions range from horizontal to an inclined slope. Paint transfer roller (110) is hollow, or solid with a density less than the fluid within the reservoir, with the ability to float on the fluid. (For example, the roller could be filled with a foam.) The journals (31) supported in roller support features (25) allow vertical motion of the paint transfer roller (110). The anti-rotation means (102) or (103), spaced above the roller support features (25), capture and prevent rotation of the polygon ends (111) of paint transfer roller (110) when the paint transfer roller (110) floats up due to the buoyancy of the paint in the reservoir, effecting a blockage of rotation of the paint transfer roller (110). Applying downward pressure on the paint transfer roller (110) during the paint transfer process, by using the paint pad assembly (40), (50) or (60) to press on the paint transfer roller (110) downwardly, releases the polygon ends (111) from the anti-rotation means (102) or (103), allowing rotation of the paint transfer roller (110). Repeating the paint transfer process will advance the rotation of the paint transfer roller (110) supplying paint to the paint pad assembly (40), (50) or (60). Thus, well-wetted surfaces of the roller are always available at the upper surfaces of the roller, to efficiently and reliably transfer paint to the paint pad. It should also be noted that alternate anti-rotation means, such as mechanical ratchets, clutches, surface textures, and inverted tapered journal supports, could also be employed to prevent reversed rotation of the transfer roller, without departing from the spirit of the invention.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. as a painting kit, those skilled in the art will recognize that its usefulness is not limited thereto and that the present invention can be beneficially utilized in any number of environments and implementations where it is desirable to apply a paint coating up to an edge of a surface. In addition to paint, a variety of other fluids that might be applied with the device of the invention are listed above, as non-limiting examples. Accordingly, the claims set forth below should be construed in view of the full breadth and spirit of the invention as disclosed herein.

The invention claimed is:

1. A liquid applicator system comprising:

a tray formed with a liquid reservoir suitable for holding liquid therein;

at least one applicator comprising an applicator absorbing surface capable of absorbing liquids; and a transfer element associated with the tray, for transferring liquid from the liquid reservoir to an applicator absorbing surface;

wherein said applicator absorbing surface has an area; and wherein the transfer element transfers liquid onto less than the entire area of the applicator absorbing surface;

wherein said transfer element comprises a transfer roller supported for rotation with respect to the tray, wherein said transfer roller is partially immersed in the liquid held in the liquid reservoir and partially above the level of liquid in the liquid reservoir, and wherein liquid is transferred to said applicator absorbing surface through rolling contact of said applicator absorbing surface with said transfer roller;

wherein the transfer roller has a substantially uniform outside diameter over a longitudinal length and the longitudinal length makes rolling contact with less than a corresponding dimension of an applicator absorbing surface;

and wherein the transfer roller is segmented to split its substantially uniform outside diameter into a first length and a second length, wherein said first length makes rolling contact with less than a corresponding dimension of a first applicator absorbing surface, and said second length makes rolling contact with less than a corresponding dimension of a second applicator absorbing surface.

* * * * *